US006070433A

United States Patent [19]

Smith, IV et al.

[11] Patent Number: 6,070,433

[45] Date of Patent: Jun. 6, 2000

[54] RECIRCULATION OF ARGON SIDEARM COLUMN FOR FAST RESPONSE

[75] Inventors: Oliver Jacob Smith, IV, New Tripoli; David Miller Espie, Lansdale, both of Pa.

[73] Assignee: Air Products and Chemicals, Inc., Allentown, Pa.

[21] Appl. No.: 09/240,257

[22] Filed: Jan. 29, 1999

[51] Int. Cl.[7] ..... F25J 1/00

[52] U.S. Cl. ..... 62/648; 62/656; 62/924

[58] Field of Search ..... 62/648, 656, 924

[56] References Cited

U.S. PATENT DOCUMENTS

| | | | |
|---|---|---|---|
| 5,100,447 | 3/1992 | Krishnamurthy et al. | 62/924 |
| 5,255,522 | 10/1993 | Agrawal et al. | 62/924 |
| 5,448,893 | 9/1995 | Howard et al. | 62/924 |
| 5,505,051 | 4/1996 | Darredeau et al. | 62/21 |

FOREIGN PATENT DOCUMENTS

| | | |
|---|---|---|
| 3436897 C2 | 1/1993 | Germany . |
| 19724287A1 | 2/1998 | Germany . |
| 19734482A1 | 3/1998 | Germany . |
| 2316476A | 2/1998 | United Kingdom . |

*Primary Examiner*—Ronald Capossela
*Attorney, Agent, or Firm*—Willard Jones, II

[57] ABSTRACT

A process for separating mixtures which comprise oxygen, nitrogen, and argon by cryogenic distillation in a distillation system where the system is comprised of a distillation column that produces a nitrogen-enriched stream, an oxygen-enriched stream, and an argon-enriched stream, and a sidearm column which has a sump and receives the argon-enriched stream from the distillation column. During an interruption of flow of the argon-enriched stream into the sidearm column, the liquid inventory in the sidearm column is collected at a point above the sump and recirculated through the sidearm column during re-startup of the sidearm column.

17 Claims, 6 Drawing Sheets

RECIRCULATION OF ARGON SIDEARM COLUMN FOR FAST RESPONSE

CROSS REFERENCE TO RELATED APPLICATIONS

Not Applicable

STATEMENT REGARDING FEDERALLY SPONSORED RESEARCH OR DEVELOPMENT

Not applicable

FIELD OF THE INVENTION

The present invention relates to a cryogenic air separation process. More specifically, the present invention relates to a process for restarting a sidearm column used in argon/oxygen separation.

BACKGROUND OF THE INVENTION

A common method for recovering argon from air is to use a double column distillation system comprising a higher pressure column and a lower pressure column which are thermally linked with a reboiler/condenser. Typically, a sidearm rectifier column is attached to the lower pressure column. The oxygen product is withdrawn from the bottom of the lower pressure column and at least one nitrogen-enriched stream is withdrawn from the top of the lower pressure column. A portion of the vapor rising through the lower pressure column is withdrawn from an intermediate location and passed to the sidearm column. This portion, which generally contains between 5 mole % and 20 mole % argon, traces of nitrogen, and balance oxygen, is rectified in the sidearm column to produce an argon-enriched stream which is substantially free of oxygen. Typically, this argon enriched stream is withdrawn from the top of the sidearm column with an oxygen content ranging from 1 ppm to 3 mole % oxygen.

The rectification in the sidearm column is achieved by providing liquid reflux to the sidearm column via a condenser located at the top of the sidearm column. The sidearm column need not be contained in only one vessel but can be split into more than one vessel. Each vessel is connected to the next vessel in the series by a vapor and liquid stream from the top of the preceding column top to the bottom of the next column. The bottom of the first vessel is attached to the lower pressure column and the top of the last is vessel contains a condenser as described above. Typically, the number of sidearm columns is determined by a desire to limit the total height of the system. The number of columns is based on operating needs in conjunction with overall height limitations.

Due to the relatively small difference between the volatility of argon and oxygen, producing a high purity argon stream requires a large number of theoretical stages in the sidearm rectifier column. Also, the argon concentration in air is low. A typical value is below 1 mole % argon. Both the large size of these sidearm columns, and the small flow rate of argon in the air fed to the overall plant, make them slow to return to their steady-state purity and production rates after a process interruption. In the startup or re-startup of a typically sized sidearm column, approximately 30 hours are often needed to accumulate enough liquid argon inventory and then another 10 hours are needed to properly redistribute the argon so as to re-establish the steady-state composition profile. Thus, a total of up to about 40 hours is necessary to restart the sidearm column. This is time in which the production of the argon product must be foregone.

The retention of the argon inventory in the sidearm column, which can represent many hours of production, has been shown in prior art to be important when trying to reduce the time necessary to return the sidearm column to its steady-state conditions. Because the concentration of oxygen at the top of the column can be below 1 ppm, and the concentration at the bottom ranges between 80 mole % and 95 mole % oxygen, when the column's liquid inventory is accumulated it is much richer in argon than the feed stream normally available to the sidearm column.

German Patent DE 34 36 897, and U.S. Pat. No. 5,505,051 both disclose methods to retain an argon rich liquid inventory of the sidearm column in one repository. After the sidearm column is restarted, the argon rich inventory is gradually returned to the sidearm column by progressively lowering the level in the repository until it returns to the steady-state value.

German Patent DE 197 34 482 discloses the practice of not only saving the sidearm column inventory but further storing it in more than one repository. The liquid is segregated into more than one repository according to argon concentration so as not to nullify the distribution of the argon already available in the column. After restarting the sidearm column, the stored liquid is returned to the sidearm column in different segments according to the concentration of the more volatile argon. All liquid is returned to the sidearm column as reflux liquid which, unless there is a proper vapor flow rate in the column, will either accumulate in the sump or contaminate the oxygen product in the bottom of the low pressure column. This patent illustrates the importance of retaining argon inventory in the sidearm column and of preserving the steady-state concentration profile in order to decrease the time necessary to restart an argon sidearm column.

SUMMARY OF THE INVENTION

Therefore, in one aspect, the present invention is a process for separating mixtures which comprise oxygen, nitrogen, and argon by cryogenic distillation in a distillation system where the system is comprised of a distillation column that produces a nitrogen-enriched stream, an oxygen-enriched stream, and an argon-enriched stream, and a sidearm column which has a sump and receives the argon-enriched stream from the distillation column. The process is characterized in that during an interruption of flow of the argon-enriched stream into the sidearm column, the liquid inventory in the sidearm column is collected at a point above the sump and recirculated through the sidearm column during the interruption and during re-startup of the sidearm column.

In another aspect, the present invention is a process for separating mixtures which comprise oxygen, nitrogen, and argon by cryogenic distillation in a distillation system where the system is comprised of a distillation column that produces a nitrogen-enriched stream, an oxygen-enriched stream, and an argon-enriched stream, and a sidearm column which receives the argon-enriched stream from the distillation column. The process is characterized in that during an interruption of flow of the argon-enriched stream into the sidearm column, the liquid inventory in the sidearm column is collected and retained during the interruption and is then recirculated through the sidearm column prior to and during re-startup of the sidearm column.

DETAILED DESCRIPTION OF THE INVENTION

Figure 1:
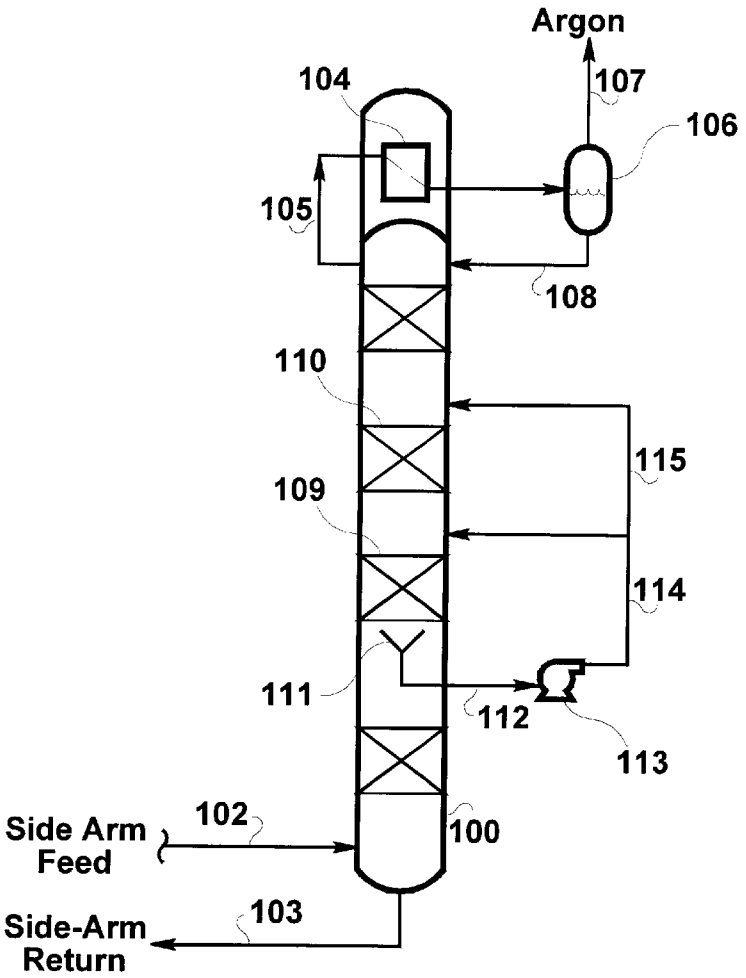
FIG. 1 illustrates a process flow diagram of one embodiment of the present invention wherein one collector is used and liquid is reintroduced at two points in the column.

The present invention teaches efficient and more operable processes for the restarting of an argon sidearm column. The invention is applicable to the production of argon with any acceptable oxygen concentration but generally with an oxygen content ranging from ppm levels to 3 mole % oxygen. In this method, feed containing oxygen, nitrogen, and argon (typically air) is distilled and argon is recovered in a cryogenic distillation system. The system comprises at least one distillation column that produces a nitrogen-enriched stream from its top and an oxygen product stream from its bottom. The column also produces an argon containing intermediate stream which is passed to a sidearm column. The invention involves retaining the argon enriched liquid inventory of the sidearm column upon a processing interruption and then recirculating it continuously to the sidearm column before and during the time the column is restarted.

During the time in which the sidearm column is shut down, it is possible to constantly recirculate the liquid inventory. This results, however, in unnecessarily high energy costs. Instead, it is preferable to begin recirculating the liquid inventory just prior to restarting the column. After the initiation of the recirculation, recirculation occurs throughout the startup process. Generally, the re-startup process is over when the column reaches its steady state conditions again. At the point where the sidearm column is again operating at steady state, the recirculation can be terminated. During the startup process, as the sidearm column approaches steady state conditions, the recirculation can be progressively reduced. Moreover, as the sidearm column advances from being shut-down to its normal operating conditions, the amount of liquid inventory being recirculated is progressively reduced.

In a preferred mode, the argon-enriched inventory should be retained in a number of repositories to preserve the existing argon concentration profile in the sidearm column. Also in this mode, each portion of the retained inventory should be recirculated through a different section of the sidearm column. The recirculation sections are chosen based upon the argon concentration of the liquid with liquids of higher argon concentration being added at locations higher in the column.

The invention will now be described in detail with reference to an embodiment shown in FIG. 1. An argon-containing vapor stream is supplied by a cryogenic distillation process as stream 102. This argon containing stream, which may contain between 3 mole % to 25 mole % argon (but typically contains between 5 mole % to 15 mole % argon), is passed to the sidearm column 100 as a bottom feed. The argon-containing feed to the sidearm column is distilled to reduce the oxygen concentration in the ascending vapor and produces a top vapor 105 and a bottom liquid stream 103. The bottom liquid stream is returned to the cryogenic distillation process. The top vapor 105 from the sidearm column is at least partially condensed in reboiler/condenser 104 to form a two-phase stream which is then passed to separator 106 to collect liquid reflux for the sidearm column as stream 108 and the purified argon stream 107. Also, although not shown in FIG. 1, the argon product could be removed from the sidearm column as a liquid. The sidearm column could also be split into more than one vessel where each is interconnected by vapor and liquid streams.

According to the invention, upon a process interruption which causes vapor stream 102 to be reduced or to cease flowing altogether, the liquid inventory from the column sections above collector 111 is accumulated by collector 111 and recirculated back to the sidearm column via stream 112 and pump 113 as liquid to one or more upper sections of the sidearm column 100. In this embodiment, recirculation occurs throughout the shutdown. FIG. 1 illustrates the scenario where the liquid is recirculated by pump 113 to two upper sections 109 and 110 via stream 114 and 115. The upper sections need not be contiguous as in FIG. 1 but may be separated by one or more other column sections. Because the flow of vapor stream 102 which is necessary to holdup all of the retained liquid is not present (or is not adequate to hold up all liquid), the liquid returned to the column by streams 114 and 115 will fall over the column internals and again be collected by collector 111. By this means the liquid can be recirculated through the desired section or sections of the column independent of vapor stream 102 or reboiler/condenser 104 which supply the liquid traffic during normal operation.

The liquid which is accumulated and recirculated is that liquid in the column internals above the collector 111 which would have otherwise run down the column. Typical column internals that need an opposing vapor flow to holdup liquid include trays, packing and distributor devices. Typically, distillation trays or structured packing comprise the column internals, both in the sidearm column(s) and the distillation column. The collector 111 can be located at the top or bottom of the column as well as any other intermediate location. When the column is restarted and the flow of vapor stream 102 is increased such that some column liquid is needed, the percent of the liquid traffic in the section that is recirculated is decreased. This allows some of the liquid to travel down the column and provide the normal liquid necessary to strip the rising vapor. When the vapor stream 102 has been fully restored to its normal flow, no more liquid needs to be recirculated and the collector 111 and pump 113 are disengaged.

The embodiment of the invention described in FIG. 1 provides, as one advantage over the prior art processes, that the collection and recirculation of the liquid inventory allows the argon concentration profile to be re-established independent of the vapor stream 102. This advantage manifests itself by allowing the liquid hold-up in the column internals to be filled with the highly enriched argon inventory that was retained before any sidearm feed vapor condenses. The sidearm feed has a lower argon concentration and thus that which condenses in the upper portion of the column will pollute any inventory that is added subsequently. By not allowing the vapor to be present to condense, the liquid concentration profile of the sidearm column can be preserved when adding the retained inventory. Reestablishing the concentration profile quicker allows the column to be restarted more quickly. Being able to manipulate the liquid rates in sections of the sidearm column independent of vapor stream 102 and reboiler/condenser 104 could also have advantages for column operation during transient load changes such as increasing or decreasing feed or production rates.

Figure 2:
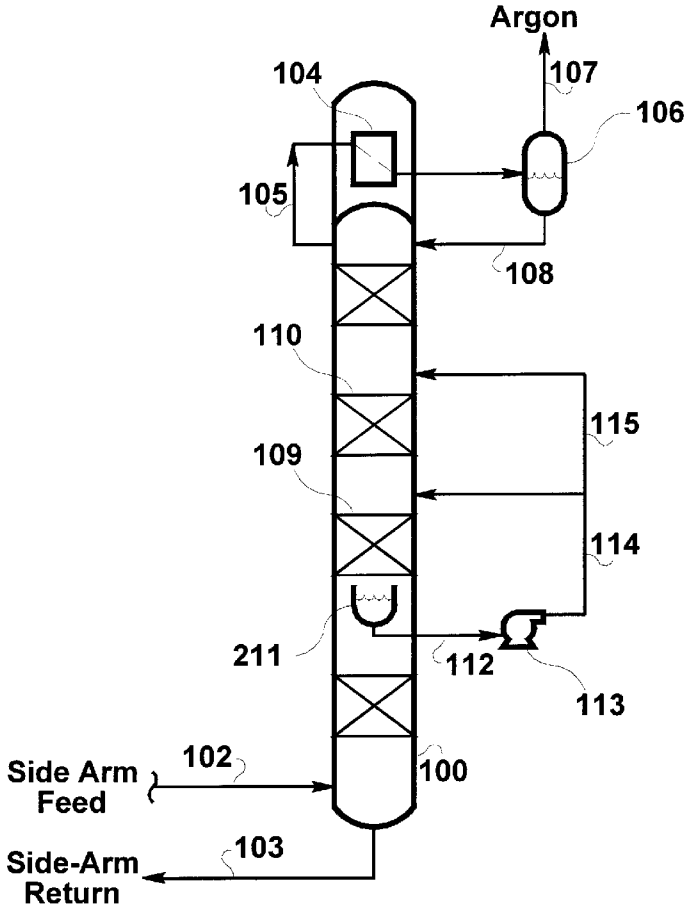
FIG. 2 illustrates a process flow diagram of another embodiment of the present invention wherein an internal repository is used and liquid is reintroduced at two points in the column.

FIG. 2 illustrates another embodiment of the invention. For the process shown FIG. 2, upon a process interruption which causes vapor stream 102 to be reduced or cease flowing altogether, the liquid inventory from the column sections above repository 211 is collected and retained internally in the sidearm column 100 in repository 211. This differs from the embodiment shown in FIG. 1 where the column liquid inventory was not stored (but rather continuously recirculated) throughout interruption or shutdown. Here, the liquid inventory can be retained in repository 211 until it is to be recirculated back to one or more upper sections of sidearm column 100. Recirculation to two sections would occur as described above via stream 112 to pump 113 and then to the two upper sections of the column as streams 114 and 115.

The embodiment described in FIG. 2 has a particular advantage. Because the liquid is retained within the column, there is no need to include extra piping for boiloff from the repository 211 because it has already been included as part of the normal configuration for sidearm column 100. Another particular advantage for this embodiment is that repository 211 can also be used during normal operation to control liquid level in the column, such as when it is configured as the sump of the sidearm column. In that case, the additional capital investment for the inclusion of repository 211 and its accompanying control equipment is greatly reduced because the sidearm column sump can be utilized to store the liquid inventory until it is to be recirculated as described above.

Figure 3:
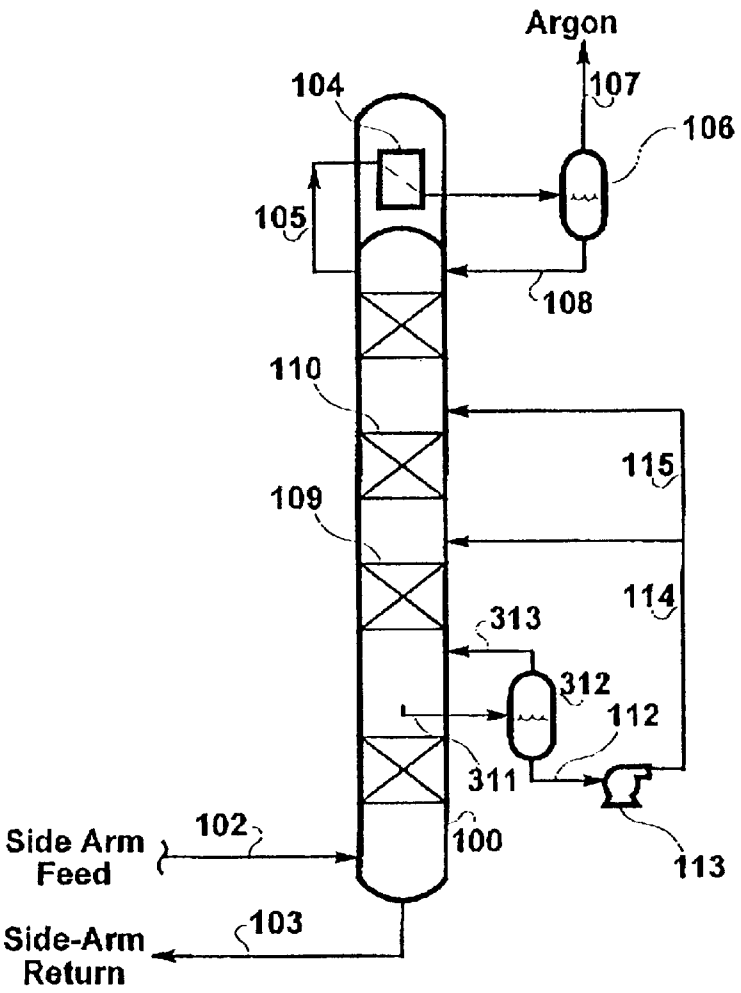
FIG. 3 illustrates a process flow diagram of another embodiment of the present invention wherein an external repository is used and liquid is reintroduced at two points in the column.

FIG. 3 shows another embodiment of the invention and represents an alternative to the process of FIG. 2. Upon a process interruption, the liquid inventory from the column sections above a collection means is collected as stream 311 and retained external to the sidearm column 100 in repository 312. Because the repository 312 is outside of the column, vapor stream 313 must be removed from the top of the repository 312 due to liquid boiloff and fed to column 100. The sidearm column liquid inventory can be retained in repository 312 until it is to be recirculated back to one or more upper sections of sidearm column 100 via pump 113 as stream 114 and/or 115. The embodiment in FIG. 3 has the particular advantage in that it could be easily retrofitted to an existing sidearm column with a minimal amount of capital investment.

Figure 4:
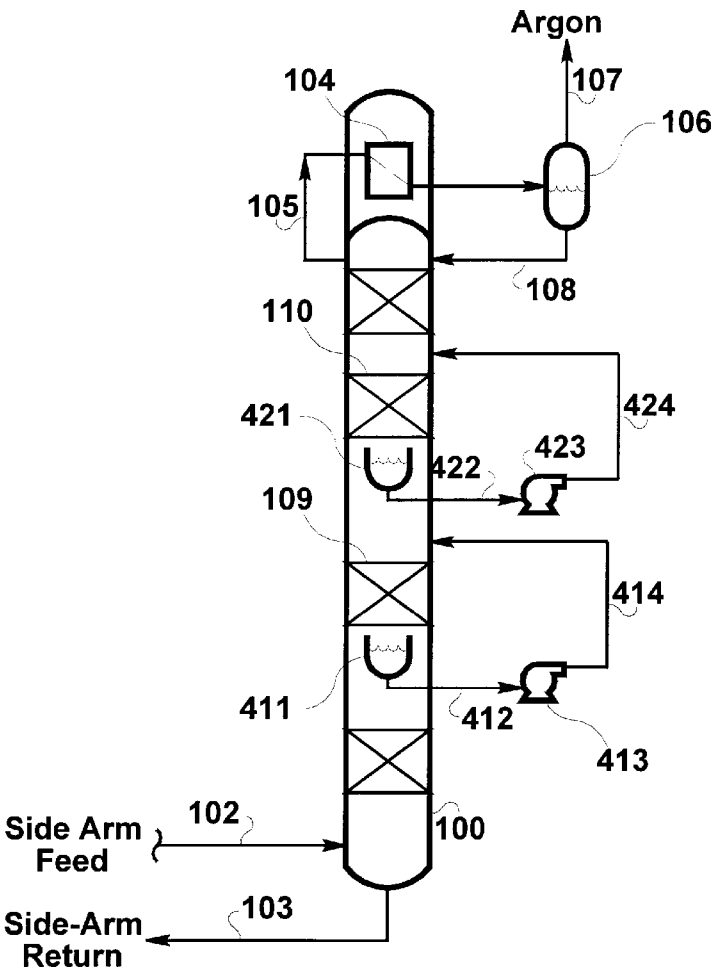
FIG. 4 illustrates a process flow diagram of yet another embodiment of the present invention wherein two separate internal repositories are used and each provides recirculation to a single point in the column.
Figure 5:
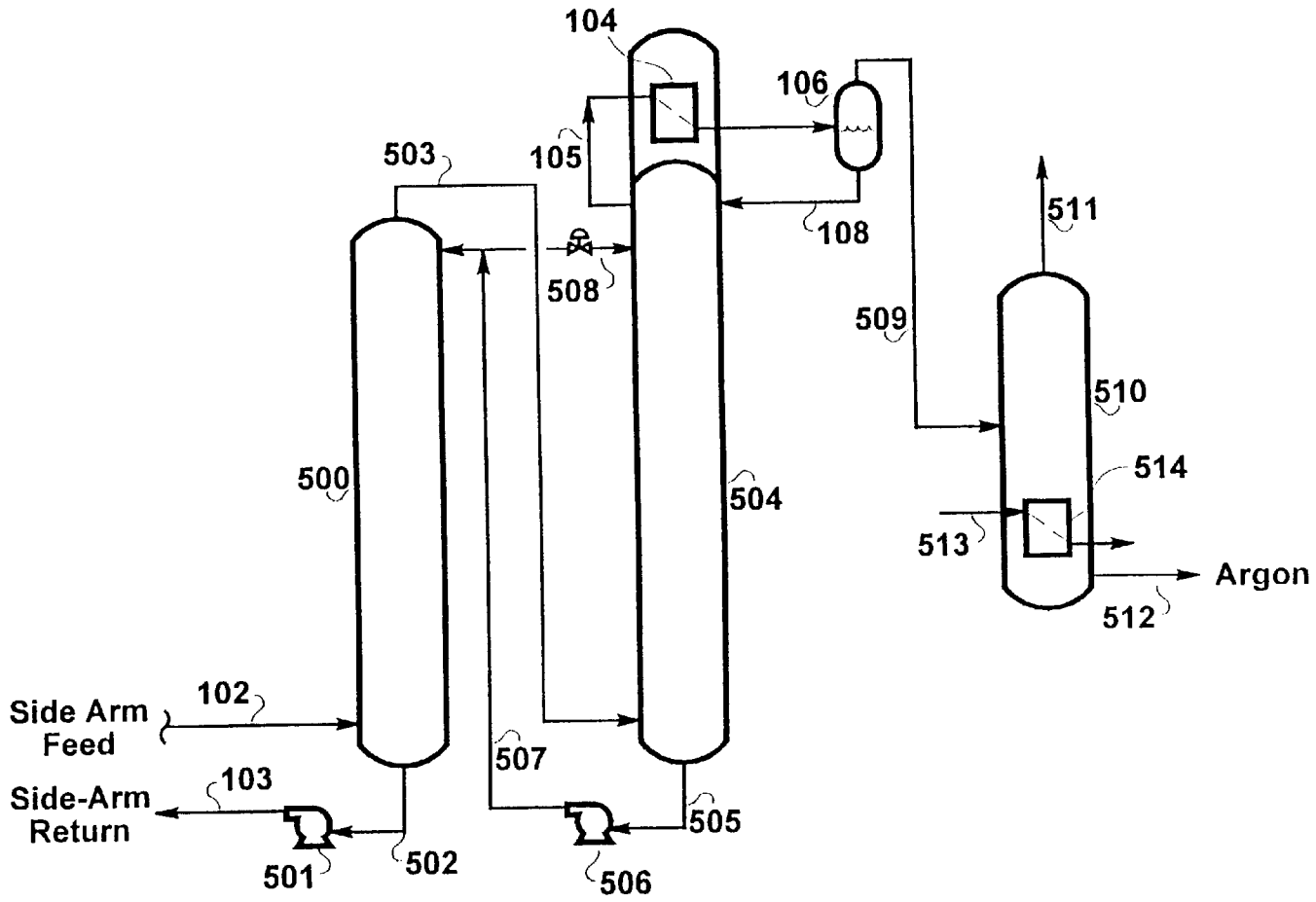
FIG. 5 illustrates a process flow diagram of still another embodiment of the present invention wherein a second sidearm column acts as the repository from which liquid is recirculated back to a first sidearm column.

FIG. 4 shows another embodiment of the invention. For the process in FIG. 4, upon a process interruption, the liquid inventory from the sidearm column 100 is collected and retained in repositories 411 and 421. Of course, any number of repositories may be used. In addition, these repositories could be either internal or external to the sidearm column. Upon a restart of the sidearm column 100, the liquid from each repository is recirculated back to the sidearm column 100 separately to one or more different upper column sections. The embodiment in FIG. 4 has an advantage in that the multiple repositories allow liquid inventory with different argon concentrations to be saved and recirculated separately. This allows the argon concentration profile in the sidearm column 100 to be re-established with minimal loss of previous separation work. This type of embodiment is particularly advantageous when the sidearm column is split into two or more vessels where each vessel has a separate sump. In such a case, each sump can be configured as the internal repositories 411 and 421, thereby greatly decreasing overall capital investment. The liquid inventory in each repository can then be recirculated back to the top of the respective vessel from which it was collected before restarting. FIG. 5 shows just such an embodiment.

FIG. 5 shows an argon-containing vapor stream supplied by a cryogenic distillation process as stream 102. This argon-containing stream 102, which may contain between 3 mole % to 25 mole % argon, but typically contains between 5 mole % to 15 mole % argon, is passed to a first sidearm column 500 as a bottom feed. The argon-containing feed to the sidearm column is distilled to reduce the oxygen concentration in the ascending vapor and produces a top vapor 503 and a bottom liquid stream 502. The bottom liquid stream is transferred to the cryogenic distillation process by pump 501 via stream 103. The top vapor 503 is passed to the second sidearm column 504 as a bottom feed. This argon-containing feed is further distilled to reduce the oxygen concentration in the ascending vapor and produces a top vapor stream 105 and a bottom liquid stream 505.

The bottom liquid stream 505 is transferred back to the first sidearm column 500 by pump 506 via stream 507, as a top liquid feed. The top vapor stream 105 from the second sidearm column 504 is at least partially condensed in reboiler/condenser 104 to form a two-phase stream which is then passed to separator 106 to collect liquid reflux for the second sidearm column 504 as stream 108, and a purified argon stream 509. Stream 509 is passed as a feed stream to the argon purification column 510.

The feed stream 509 is rectified and stripped in column 510 to produce a bottom stream 512 which is purified argon and a top stream 511 which contains more concentrated nitrogen impurities. The duty for reboiler 514 is obtained by feed stream 513 which is typically a purified oxygen stream. Also, although not shown in FIG. 5, the argon product could be removed from the top of the second sidearm column as a liquid from separator 106.

According to the invention, upon a process interruption, the liquid inventory from the second sidearm column 504 is collected in the sump of the column. Upon a restart of sidearm columns 500 and 504, the liquid contained in the sump of the second sidearm column 504 is recirculated back to the second sidearm column 504 to a location above the sump via stream 508. Part of said liquid may also be recirculated back to the first sidearm column 500.

Figure 6:
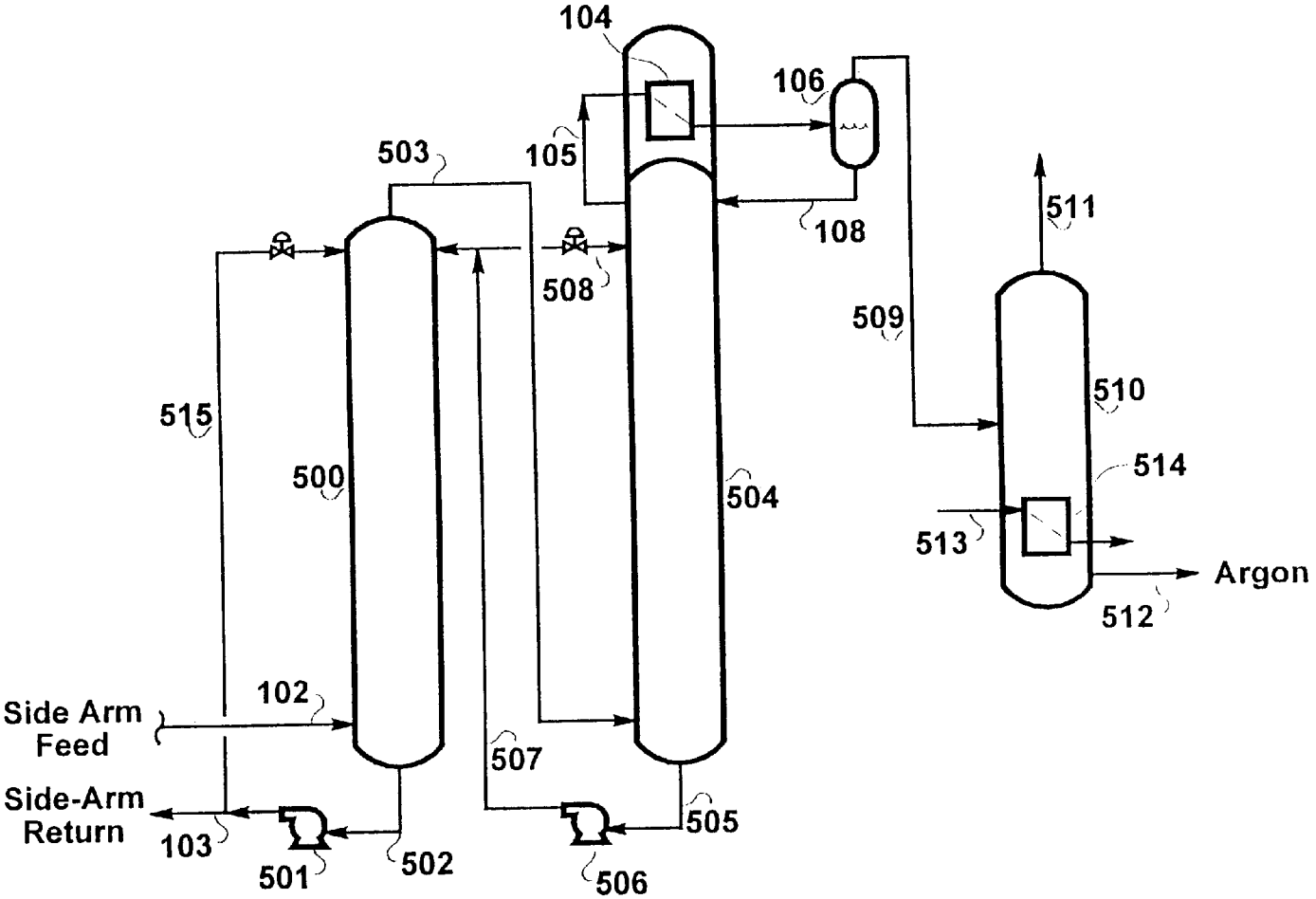
FIG. 6 illustrates a process flow diagram of still yet another embodiment of the present invention wherein recirculation occurs in both a first sidearm column and a second sidearm column.

FIG. 6 shows yet another embodiment of the invention. Upon an interruption which causes vapor stream 102 to be reduced or cease flowing altogether, the liquid inventory from the first sidearm column 500 is retained in the sump of column 500 and the liquid inventory from the second sidearm column 504 is retained in the sump of column 504. Upon a restart of the sidearm columns 500 and 504, the liquid contained in the sump of the first sidearm column 500 is recirculated back to the first sidearm column 500 to a location above the sump. At the same time, the liquid contained in the sump of the second sidearm column 504 is recirculated via stream 508 back to the first sidearm column 504 to a location above the sump.

The method according to the invention is further illustrated by the following examples. The operation of restarting an argon sidearm column was simulated dynamically for a number of different scenarios. The simulations determine the time at which an oxygen impurity of 1 ppm is first obtained at the top of the argon sidearm column after the column is restarted a total reflux. The time to re-establish the full production flow rate of argon will be longer. The results are presented in the Table below as improvement over the Base Case:

TABLE

| Example | Description | Percent Improvement in Time to 1 ppm $O_2$ (hr) Over Base Case |
|---|---|---|
| 1 | Base Case (no retention) | n/a |
| 2 | Prior Art - Vapor Stage 80 | 38.8 |
| 3 | Prior Art - Liquid Stage 1 | 44.2 |
| 4 | Invention of FIG. 2 | 50.4 |
| 5 | Invention of FIG. 4 | 63.6 |

The examples simulated are:
1. Base Case - do not retain any sidearm liquid inventory upon interruption, so upon restart no inventory is added or recirculated.
2. Prior Art (Vapor Stage 80) - as taught by German patent 34 36 897, retain the liquid inventory from the top 80 theoretical stages and add as a vapor stream at the bottom of the section on restart.
3. Prior Art (Liquid Stage 1) - as taught by German patent 34 36 897 and U.S. Pat. No. 5,505,051, retain the liquid inventory from the top 80 theoretical stages and add as a liquid at the top of the section on restart.
4. Invention of FIG. 2 - retain the liquid inventory from the top 80 theoretical stages and recirculate the liquid through this column section before restarting.
5. Invention of FIG. 4 - retain the liquid inventory from the top 80 theoretical stages and the bottom 120 theoretical stages separately and recirculate the liquid through both sections separately before restarting.

Example 1 is a comparative simulation of the conventional argon sidearm column restarting procedure where no liquid inventory is retained. In such a case, there is nothing available on restart.

Examples 2 and 3 illustrate methods according to prior art in which the liquid inventory for a portion of the column is retained and then added back to the section on restart. The retained inventory is added back at a constant rate. The inventory was either vaporized and added to the bottom of the section or returned as a liquid to the top.

Examples 4 and 5 illustrate methods according to the present invention. For Example 4, the exact same liquid inventory was retained as was retained in Examples 2 and 3. In example 4, an 14% reduction in restart time was achieved over Example 3 due to the re-establishment of the argon concentration profile by liquid recirculation. Example 5 retains the liquid inventory in two sections of the sidearm column and recirculates it separately through the respective sections. In Example 5, a 63.6% reduction in restart is achieved over the base case example. It can be appreciated from these examples that retaining and recirculating the sidearm column inventory can be used to significantly decrease the time necessary to restart an argon sidearm column.

Although illustrated and described herein with reference to certain specific embodiments, the present invention is nevertheless not intended to be limited to the details shown. Rather, various modifications may be made to the details within the scope and range of equivalents of the claims, without departing from the spirit of the invention.

What is claimed:

1. A process for separating mixtures which comprise oxygen, nitrogen, and argon by cryogenic distillation in a distillation system where said system is comprised of a distillation column that produces a nitrogen-enriched stream, an oxygen-enriched stream, and an argon-enriched stream, and a sidearm column which has a sump and receives said argon-enriched stream from said distillation column; the process characterized in that during an interruption of flow of said argon-enriched stream into said sidearm column, the liquid inventory in said sidearm column is collected at a point above said sump and recirculated through said sidearm column during said interruption and during re-startup of said sidearm column.

2. The process of claim 1 further characterized in that said recirculated liquid inventory is reintroduced to said sidearm column at one point above said collection point.

3. The process of claim 1 further characterized in that said recirculated liquid inventory is reintroduced to said sidearm column at more than one point above said collection point.

4. The process of claim 1 wherein said mixture comprising oxygen, nitrogen, and argon is air.

5. The process of claim 1 wherein one or both of said distillation column and said sidearm column has structured packing internals.

6. The process of claim 1 wherein one or both of said distillation column and said sidearm column has distillation tray internals.

7. A process for separating mixtures which comprise oxygen, nitrogen, and argon by cryogenic distillation in a distillation system where said system is comprised of a distillation column that produces a nitrogen-enriched stream, an oxygen-enriched stream, and an argon-enriched stream, and a sidearm column which receives said argon-enriched stream from said distillation column; the process characterized in that during an interruption of flow of said argon-enriched stream into said sidearm column, the liquid inventory in said sidearm column is collected and retained during said interruption and is then recirculated through said sidearm column prior to and during re-startup of said sidearm column.

8. The process of claim 7 wherein said mixture comprising oxygen, nitrogen, and argon is air.

9. The process of claim 7, further characterized in that said liquid inventory is retained, prior to the initiation of recirculation, in a repository located inside said sidearm column.

10. The process of claim 9, wherein said sidearm column has a sump located at the bottom of said side arm column and wherein said repository located inside said sidearm column is the sump.

11. The process of claim 7, further characterized in that said liquid inventory is retained, prior to the initiation of recirculation, in a repository located outside said sidearm column.

12. The process of claim 7, further characterized in that said recirculation comprises introducing said retained liquid inventory in one location in said sidearm column.

13. The process of claim 7, further characterized in that said recirculation comprises introducing said retained liquid inventory in more than one location in said sidearm column.

14. The process of claim 7, further characterized in that said liquid inventory is retained in more than one repository, where each repository retains liquid inventory based on its argon concentration.

15. The process of claim 14, further characterized in that each of said liquid inventory retained in more than one repository is separately recirculated to said sidearm column in a different location in said sidearm column.

16. The process of claim 7 wherein one or both of said distillation column and said sidearm column has structured packing internals.

17. The process of claim 7 wherein one or both of said distillation column and said sidearm column has distillation tray internals.

* * * * *